United States Patent [19]

Meschi

[11] Patent Number: 4,858,414

[45] Date of Patent: Aug. 22, 1989

[54] PACKING CASE, PARTICULARLY FOR SHEET MATERIAL

[75] Inventor: Luciano Meschi, Livorno, Italy

[73] Assignee: Wully, S.A., Panama City, Panama

[21] Appl. No.: 137,064

[22] Filed: Feb. 22, 1988

Related U.S. Application Data

[63] Continuation of Ser. No. 581,216, Feb. 22, 1984, abandoned, which is a continuation of Ser. No. 342,747, Jan. 26, 1982, abandoned.

[30] Foreign Application Priority Data

Jan. 26, 1981 [IT] Italy ..... 20590/81[U]

[51] Int. Cl.[4] ..... B65B 5/06; B65B 63/04

[52] U.S. Cl. ..... 53/429; 53/462; 53/447; 206/215; 206/494; 229/41 R

[58] Field of Search ..... 53/462, 466, 447; 229/23 BT, 122, 41 R; 206/215, 449, 494

[56] References Cited

U.S. PATENT DOCUMENTS

| | | | |
|---|---|---|---|
| 1,337,087 | 4/1920 | Matz | 229/122 X |
| 2,119,435 | 5/1938 | Hutchison . | |
| 3,360,180 | 12/1967 | Venturi . | |
| 3,722,668 | 3/1973 | Carpenter | 229/122 X |
| 3,817,018 | 6/1974 | Vickers | 53/462 |
| 4,127,228 | 11/1978 | Hall | 229/122 X |
| 4,217,984 | 8/1980 | Magnuson | 229/23 BT X |
| 4,458,814 | 7/1984 | Meschi | 206/494 |
| 4,614,266 | 9/1986 | Moorhead | 229/41 R |

*Primary Examiner*—John Sipos

*Attorney, Agent, or Firm*—McAulay Fisher Nissen & Goldberg

[57] ABSTRACT

A packing case for sheet material consisting of a container having walls that may be lowered and are kept together in a raised condition by a cover member, whereby the removal of the cover member causes the box to open and to give full accessibility to the contents of the package.

1 Claim, 5 Drawing Sheets

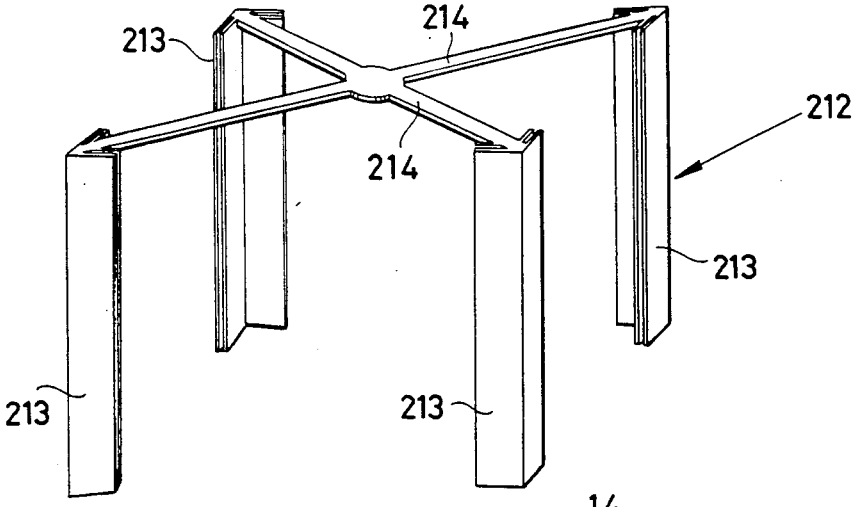
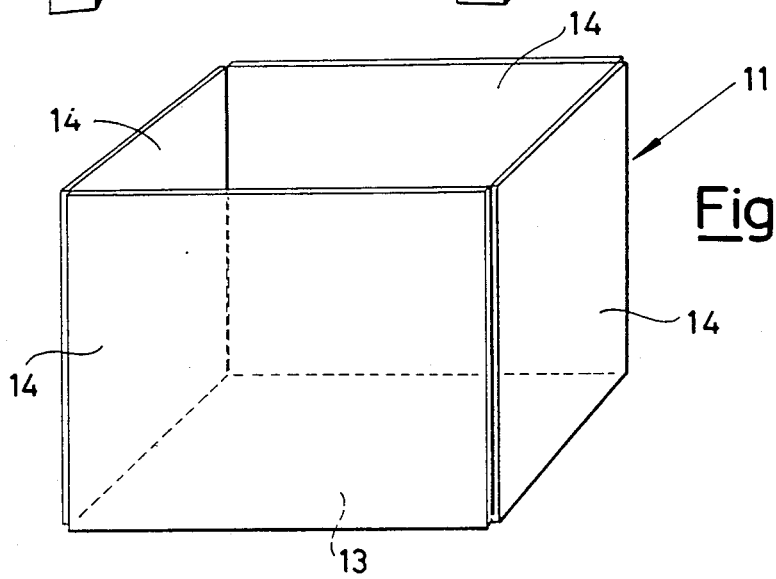
Fig.6
Fig.7
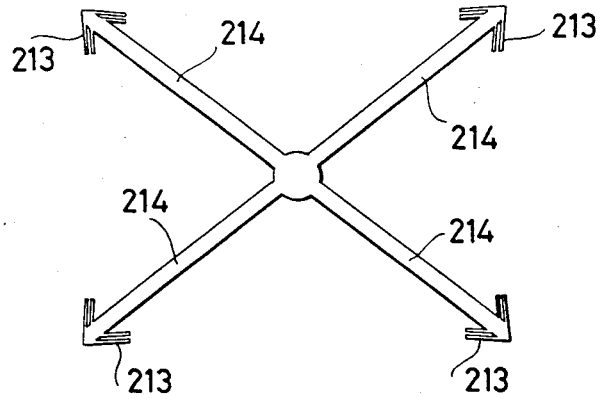
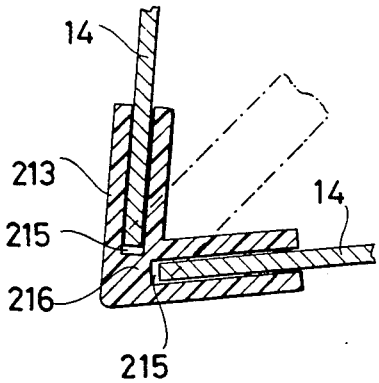
Fig.8

PACKING CASE, PARTICULARLY FOR SHEET MATERIAL

This application is a Continuation of application Ser. No. 581,216 filed on Feb. 22, 1984, now abandoned, which in turn is a Rule 62 Continuation of application Ser. No. 342,747, filed on Jan. 26, 1982, now abandoned.

BACKGROUND OF THE INVENTION

The present invention concerns a box that may be opened, useful in particular for sheet material and such that the opening of the box lip, for simple removal of a cover member permits complete accessibility to the whole contents of the box.

It is known that to package sheet material there are utilized cardboard box containers, having a bottom and an upper closing part that may be opened. However, when the packing is opened, that is by opening the upper closing part, in order to have access to the packing content, it will be necessary to break or gut the box sides, with remarkable waste of time and discomfort. In addition, by opening it in this way, the container can no longer be reutilized. In some instances, in addition to the above-mentioned problem there is also the fact that the content of the box or package is generally somewhat heavy (whenever, for instance, form packages are involved), and has to be fed as such to machines, for example accounting or computing center printing machines, copying machines, etc., whereby the content of the package (or its residues) must be quickly eliminated or emptied before "processing" the content.

OBJECTS AND SUMMARY OF THE INVENTION

The main purpose of the present invention is that of providing a box that may be opened to make the content readily accessible in its entirety.

Another object of the present invention is to provide a box that will be readily and integrally reutilizable for successive packing operations.

A further object of the present invention is to provide a box that may be opened and will be of simple structure and economical to manufacture.

These and other purposes are obtained by means of a box that may be opened, including a containing body and a cover member adapted to fit on the containing body mouth, characterized in that the walls of the containing body consist in at least four panels, independent of one another and united along one of their base sides to the common bottom of the box, whereby the panels are divided among themselves through slits corresponding to the corners of the box.

According to the preferred embodiment of the invention, the cover member is shaped to completely encompass the lateral surface of the box, add of a height that corresponds to the height of the box, so that on one side removal of the cover releases the box and permits pulling down of the lateral panels until they become substantially coplanar with the bottom; the box is thus reduced to a flat structure which can be easily extracted from the bottom of the packing content and reutilized as such for other further packagings.

In turn, the cover member is closed at its upper part with an enclosure having edges that can be restrained among themselves, so that the cover member, once extracted from the box-type container, can also be substantially flattened along a plane passing through two opposed corners and reutilized.

While the above-mentioned embodiment serves the purpose of providing the box with sufficient mechanical resistance for the stacking of many packages for the handling by pallets it is possible to provide the cover member high enough that the lateral panels of the box are kept united.

In accordance with another embodiment, the closing member of the box consist of angle sections, slidably engaging the corners of the box being angle sections united with one another with diagonally placed cross members that may serve the purpose of keeping the contents of the box in place.

These and other features, purposes and advantages of the present invention will more clearly appear from the following detailed description and attached accompanying drawings wherein.

Figure 1:
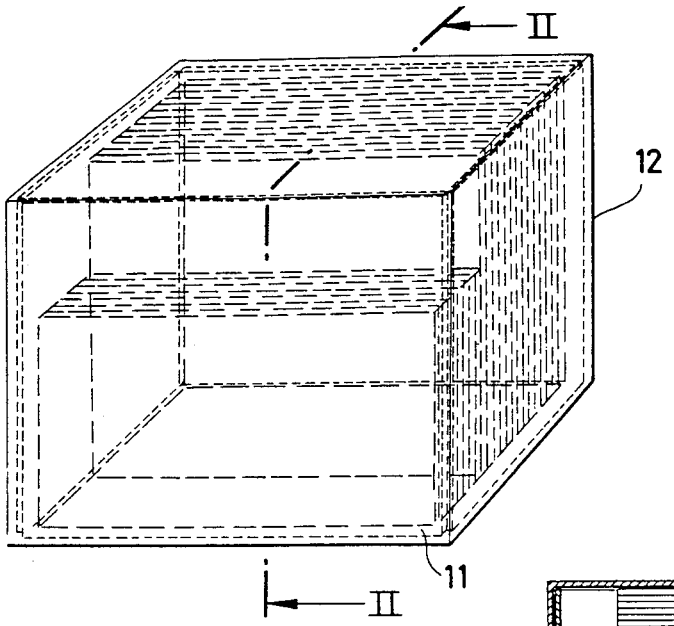
FIG. 1 is a perspective view of the box that can be opened in accordance with the invention wherein dotted lines show the inner configuration of the box and of its components.
Figure 4:
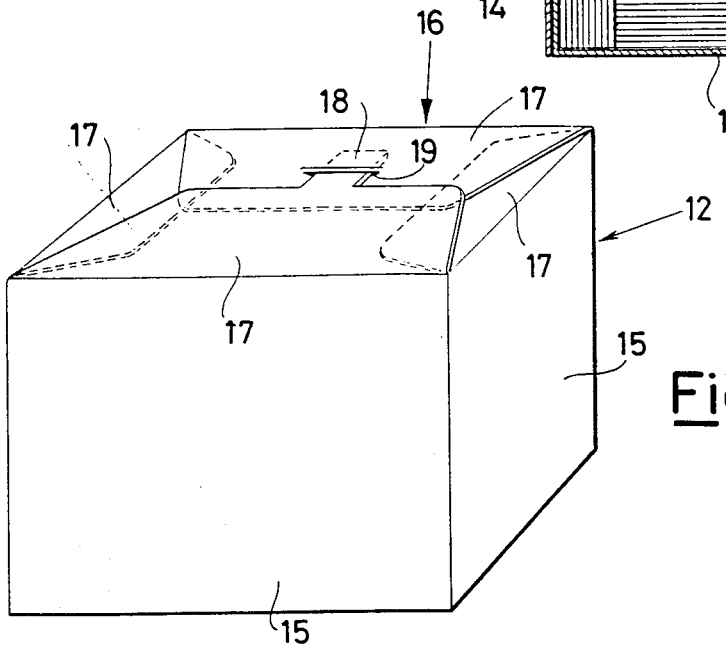
Figure 3:
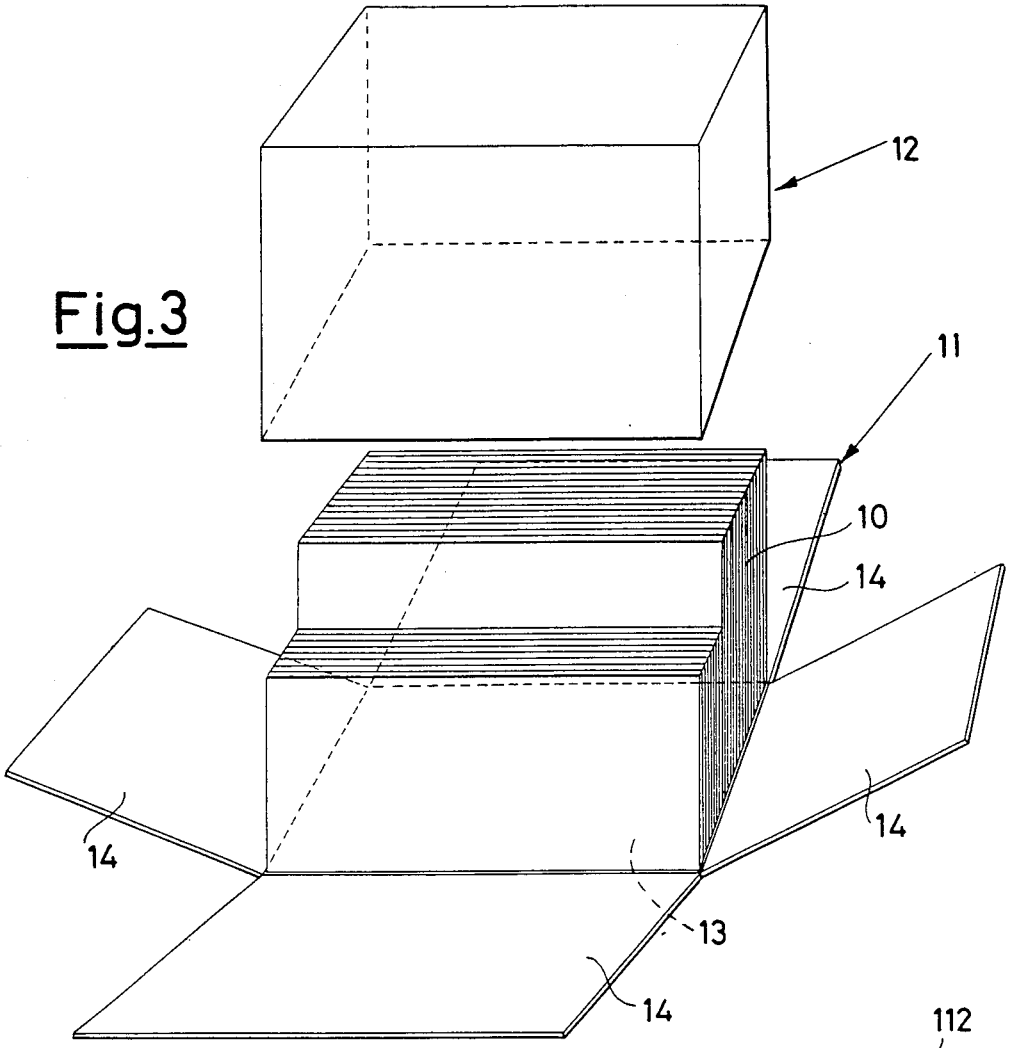
Figure 5:
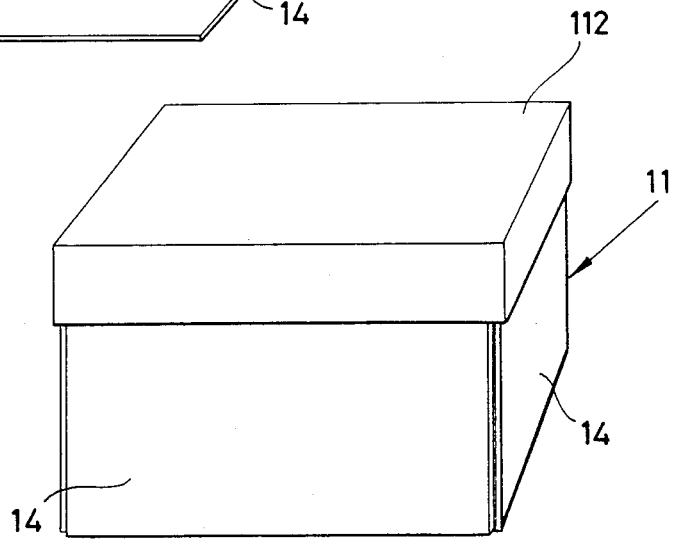

FIG. 3. is a perspective exploded view of the box of FIG. 1;

FIG. 4 is a perspective view of the cover member for the box of FIG. 1;, FIG. 5 is a perspective view of a box having a modified cover member;

FIG. 6 is an exploded view of another embodiment of the cover member; and

FIGS. 7 and 8 are detail views of the embodiment of FIG. 6.

Figure 9:
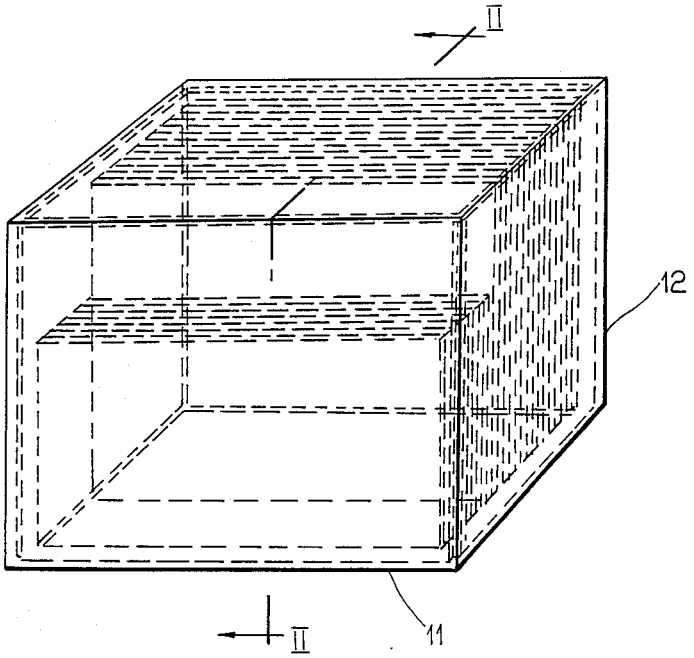
Figure 10:
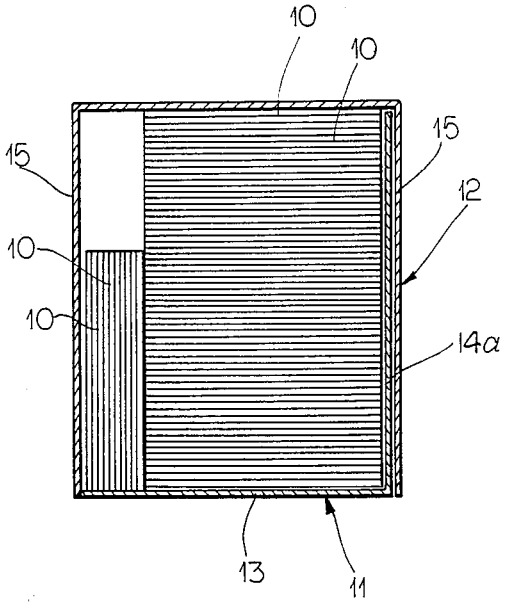
Figure 11:
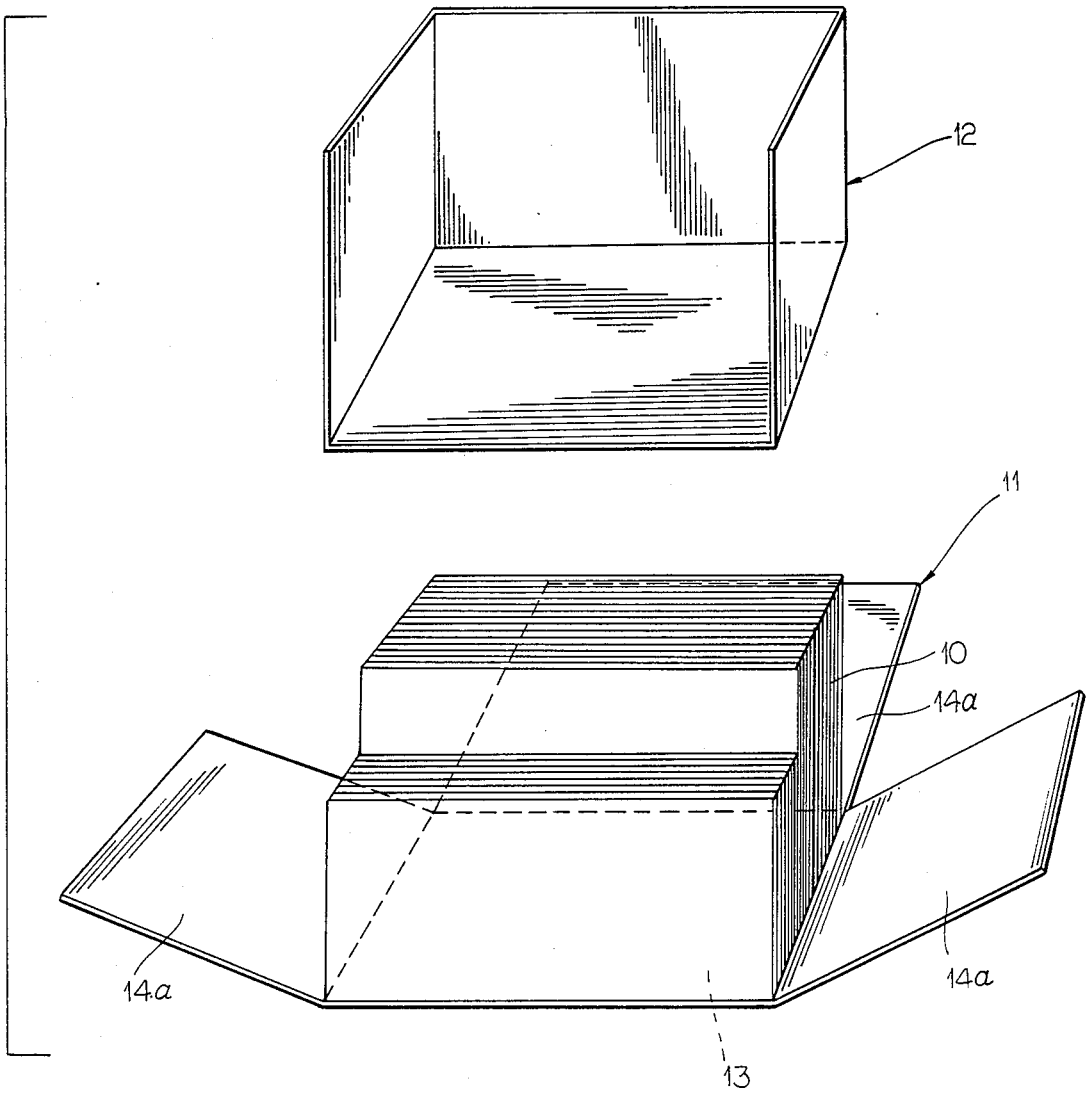

FIGS. 9–11 are views of a box with a container bottom having only three lateral flaps.

DESCRIPTION OF THE BEST MODE

Referring to FIGS. 1–4, there is shown a box containing form packages 10, united among themselves along opposed edges and adapted for feeding to fast printing machines of computing centers.

The box includes a box-type container 11 and an enclosure member 12.

The open-top container consists of a bottom panel 13 and four lateral panels 14 foldably united as a single piece along their base edges to one side of the bottom panel 13.

Between panels 14, corresponding to vertical corners of the container 11, slits are formed which permit panels 14 to fold, if not retained into vertical position in the FIG. 3 configuration.

On the container 11 is fitted an enclosure 12, including lateral panels 15 and a cover 16 formed with four folds 17, two opposite folds being engaged by means of a tongue 18 and slit 19.

As will be clearly seen from FIG. 1 and FIG. 3, the enclosure 12 is fitted on the box-type container 11, in order to retain the lateral panels 14 into vertical position. Enclosure 12 has preferably a height equal to that of the lateral panels 14, to prevent any accidental opening of the box container, but the complete package, even when entirely made with cardboard, particularly with corrugated packing board, is resistent to the vertical loads that are produced when many layers of packings will be packed for shipment.

It is evident that, when a form package has to be utilized, it will be sufficient to place the same into use position, extracting the cover member (which causes the almost complete pulling down of lateral panels 14 no longer retained into vertical position) and hence withdrawing the bottom panel and lateral panels from below the form package 10.

At the same time, by opening the folds 17 of the cover enclosure 16, the latter becomes substantially flat along the plane passing through two vertical opposed corners.

In the modification illustrated in FIG. 5, the package is substantially unchanged, except for the cover member 112, more simply formed in box-type shape having a corner height sufficient to retain panels 14 into vertical position, but without extending itself for the whole height of container 11.

Referring finally to the embodiment of FIGS. 6, 7 and 8 in this instance too the container remains unchanged, including therefore the lateral panels 14 and the bottom panel 13, while the cover member is different and consists of four angle sections 213, joined among themselves through flexible diagonal members 214.

As will be clearly seen from FIG. 7, each angle section 213 forms, on both sides in respect to the confluence corner of two panels 14 the housing seats 215 that retain the same panels.

The angle sections 213 are preferably made from plastic material, such as semi-rigid PVC, and the seats 215 are preferably tapered from the corner 216 towards their mouth, in order to increase the retaining effect. Likewise the inner surfaces of the seats 215 may be roughened in order to improve the retaining effect.

While forming the packing, the sections 213 are inserted on the corners formed between adjacent pairs of panels 14, to be thereafter extracted when the package is opened. It is clear that the cross braces 214 do not serve any important purpose, but provide a greater usefulness to the closure and packing function provided by the sections 213.

It is to be pointed out that with the package of the present invention either the bottom and lateral panels of the container body, or the cover member, are preferably made with cardboard, it being understood that it is possible to use other materials. In accordance with a modified construction of the embodiment shown in the figures from 1 to 3, in order to facilitate the withdrawal of the container 11, once the cover 12 has been carried off, at least one of the lateral panels 14 is omitted, in which case on the corresponding sides of the package the form or sheet package will be separated from the outside only by the lateral panel 15 of the parallelepipedal cover 12.

Figure 2:
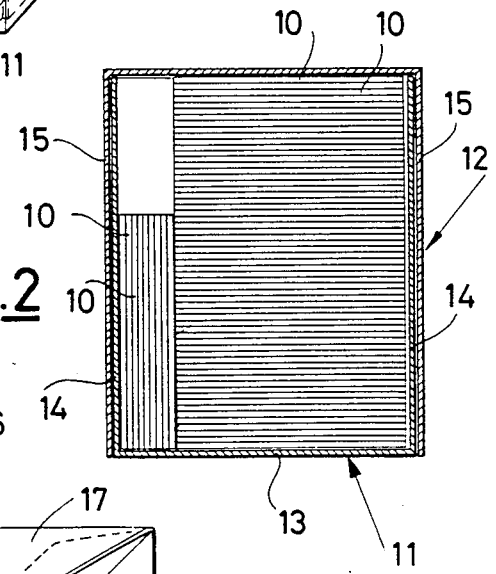
FIG. 2 is a cross sectional view taken along the plane II—II of FIG. 1.

As is evident from the drawings, the individual sheets are joined to each other in a conventional manner to form a single connected sheet prior to their being placed into the container having at least three lateral panels. These sheets, as best seen in FIGS. 1, 2 and 3, are folded over in an overlapping relationship to form a package of sheets and to permit withdrawal of the topmost sheet through the open front.

What is claimed is:

1. A process of making and using a packaging article which when opened provides complete accessibility to the while contents of the package, and which when closed is usable as a storage and shipping container, said packaging article comprising an open top container including a bottom and solely three lateral panels, each of said three lateral panels being joined only to said bottom and being pivotal along an edge thereof, and being foldable relative thereto from two orthogonal directions, said panels forming solely three angularly related sidewalls for said container when in an upstanding position to provide a box-type packing having an open top and an open side to form solely an open top and an open side container providing an open front, said angularly related sidewalls when in the upstanding position not completely closing the container and forming open portions thereof, one of the open portions being the open top and the other of the open portions being the open front, the three pivotally joined panels each individually being pivotal relative to said bottom to open themselves as a fold; and a parallelepipedal closure member having a top and depending sidewalls fitting over said three lateral panels of said container and covering the open side to close the open portions thereof and maintain said sidewalls thereof in an upright position, said sidewalls of said closure member being of sufficient height to fit substantially entirely over said panels and base of each of the sidewalls extending to said bottom to enclose said three sidewalls, the open top and the open front, the method of making the packaging article comprising:

placing a plurality of individual sheets joined to each other to form a single connected into the open top container having solely the three lateral panels;

folding the plurality of individual sheets in overlapping relationship to form a package of sheets;

placing the three lateral panels in an upstanding position against the package of sheets in said open top container; and placing the closure member over the open top container with the package of sheets therein to hold said three lateral panels against the package of sheets for shipment and/or storage of the sheets in the open top container so as to impart rigidity to the lateral panels and with a sidewall of said closure member covering the open front to prevent access to the sheets in the open top container through either the open top or the open front;

and the method of using the packaging article to dispense the sheets contained therein comprising:

removing the cover to expose the three lateral panels and the open front and releasing the three panels from their vertical position;

pulling down the three lateral panels until they are substantially coplanar with the bottom to provide complete accessibility to the sheets; and withdrawing the connected sheets from the package.

* * * * *